US012371985B2

(12) United States Patent
Jones et al.

(10) Patent No.: US 12,371,985 B2
(45) Date of Patent: Jul. 29, 2025

(54) SURFACE TRACKING SYSTEMS AND METHODS FOR DOWNHOLE WELLBORE POSITION AND TRAJECTORY DETERMINATION

(71) Applicant: Halliburton Energy Services, Inc., Houston, TX (US)

(72) Inventors: Christopher Michael Jones, Houston, TX (US); Jeffrey James Crawford, Houston, TX (US); Boguslaw Wiecek, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 222 days.

(21) Appl. No.: 17/821,966

(22) Filed: Aug. 24, 2022

(65) Prior Publication Data

US 2023/0067788 A1 Mar. 2, 2023

Related U.S. Application Data

(60) Provisional application No. 63/260,666, filed on Aug. 27, 2021.

(51) Int. Cl.
*E21B 44/00* (2006.01)
*E21B 7/06* (2006.01)
(Continued)

(52) U.S. Cl.
CPC ..... *E21B 44/00* (2013.01); *E21B 47/022* (2013.01); *E21B 49/008* (2013.01);
(Continued)

(58) Field of Classification Search
CPC ..... E21B 44/00; E21B 47/022; E21B 49/008; E21B 49/0875; E21B 7/06; E21B 2200/20
See application file for complete search history.

(56) References Cited

U.S. PATENT DOCUMENTS 4,507,958 A * 4/1985 Russell ..... E21B 47/022 702/6
2004/0249573 A1* 12/2004 McElhinney ..... G01V 3/26 702/7

(Continued)

OTHER PUBLICATIONS

The International Search Report and Written Opinion dated Dec. 6, 2022 for corresponding PCT Patent Application No. PCT/US2022/075417 filed on Aug. 24, 2022.

(Continued)

*Primary Examiner* — Yanick A Akaragwe
(74) *Attorney, Agent, or Firm* — K&L Gates LLP

(57) ABSTRACT

The present disclosure relates to systems and methods of determining a wellbore position in a subterranean formation by using gravity sensors to detect a gravity anomaly related to a presence of the wellbore, contents within the wellbore, and or fluid flowing through an interface of the wellbore. A model of the subterranean formation predicts a gravity profile, including the gravity anomaly, and the model may be constrained with a depth of the gravity anomaly as calculated with at least one of a known dimension or a known gravitational field change related to the gravity anomaly. The wellbore position is determined within the model by changing model input data until the gravity profile converges with the gravity anomaly.

18 Claims, 3 Drawing Sheets

(51) Int. Cl.

| | |
|---|---|
| ***E21B 47/022*** | (2012.01) |
| ***E21B 49/00*** | (2006.01) |
| ***E21B 49/08*** | (2006.01) |

(52) U.S. Cl.

CPC ..... *E21B 49/0875* (2020.05); *E21B 7/06* (2013.01); *E21B 2200/20* (2020.05)

(56) References Cited

U.S. PATENT DOCUMENTS

| | | | | |
|---|---|---|---|---|
| 2015/0143889 | A1 | 5/2015 | Kim et al. | |
| 2015/0204996 | A1 | 7/2015 | Dashevsky et al. | |
| 2016/0334537 | A1 | 11/2016 | Li et al. | |
| 2017/0009566 | A1* | 1/2017 | Fan | G01S 19/13 |
| 2017/0044890 | A1* | 2/2017 | Clark | E21B 47/007 |
| 2017/0111112 | A1* | 4/2017 | San Martin | H04B 10/25891 |
| 2018/0292524 | A1 | 10/2018 | Al-Shuhail et al. | |
| 2019/0004206 | A1 | 1/2019 | Li et al. | |

OTHER PUBLICATIONS

Bongs et al., Taking atom interferometric quantum sensors from the laboratory to real-world applications, Nature Reviews Physics, Dec. 2019, pp. 731-739, vol. 1.

Granger, Dale, Quantum goes deeper, PESA—Petroleum Exploration Society of Australia, Nov. 8, 2020.

James, The Gravity Delve Project aims to harness the potential of quantum gravity sensing by exploring the technology in harsh underground borehole environments, Quantum Gravity Sensing Takes the Plunge Into Underground Boreholes, Aug. 28, 2020, 4 pages.

Kumar et al., Cold atom interferometry for inertial sensing in the field, Adv. Opt. Techn., Aug. 31, 2020, pp. 221-225.

Mukherjee et al., Conceptualization, Design and prospect of Atom-Interferometry Based Full Tensor Gravity Gradiometer, FS3A.4 Frontiers in Optics (FiO), 2019, 2 pages.

University of Birmingham Enterprise, Quantum goes deeper, https://www.birmingham.ac.uk/partners/enterprise/news/latest/Quantum goes deeper.aspx, Aug. 10, 2020, 3 pages.

* cited by examiner

SURFACE TRACKING SYSTEMS AND METHODS FOR DOWNHOLE WELLBORE POSITION AND TRAJECTORY DETERMINATION

BACKGROUND

This section is intended to provide relevant background information to facilitate a better understanding of the various aspects of the described embodiments. Accordingly, these statements are to be read in this light and not as admissions of prior art.

Wellbores drilled into subterranean formations may enable recovery of desirable fluids (e.g., hydrocarbons) using any number of different techniques. Currently, drilling operations may identify subterranean formations through the use of measurements from a bottom hole assembly (BHA) within a wellbore passing through or proximate to the subterranean formation. Measurements from the BHA may also be used to calculate the BHA location, the wellbore trajectory, or other downhole measurements. However, existing methods for calculating BHA location, wellbore trajectory, or other downhole measurements suffer from inaccuracies, due in part to assumptions about the wellbore geometry and properties of the subterranean formation. In addition, current calculations of wellbore trajectory, using for example accelerometer or pressure sensor measurements, may not provide reliable measurements of direction or depth. Thus current methods of calculating wellbore trajectory have uncertainty in providing feedback of direction or depth for steerable drilling systems. Further, current methods of tracking wellbore trajectories using electromagnetic (EM) measurement techniques are limited to a few thousand feet of true vertical depth (TVD) below the surface because the electromagnetic waves may not penetrate deep into earthen formations and return signal with enough strength to quantify the BHA trajectory.

BRIEF DESCRIPTION OF THE DRAWINGS

Embodiments of the surface tracking systems and methods for downhole BHA and wellbore trajectory are described with reference to the following figures. The same or sequentially similar numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
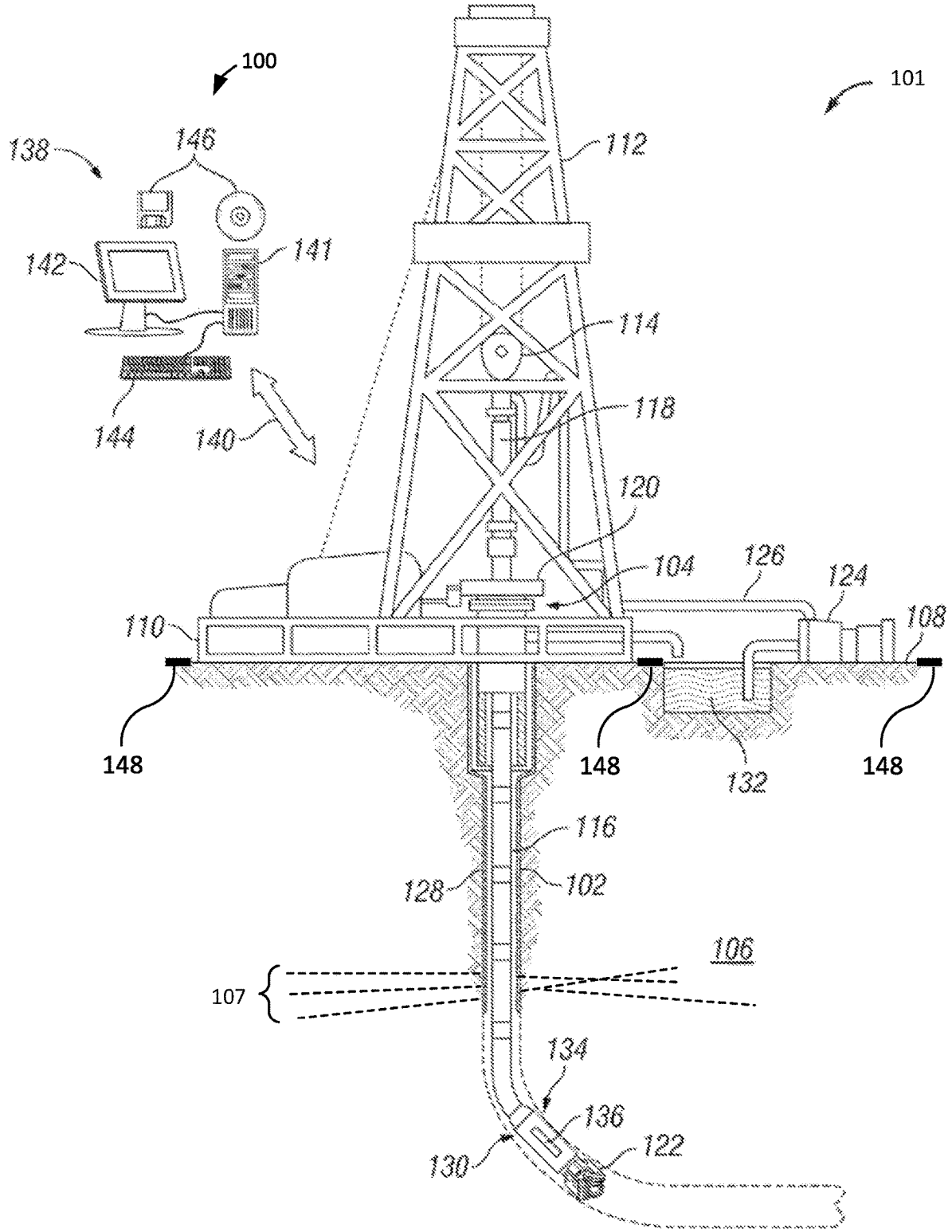
FIG. 1 illustrates an example surface tracking system used with a drilling system, in accordance with the present disclosure.

One or more specific embodiments of the present disclosure will be described below. In an effort to provide a concise description of these embodiments, not all features of an actual implementation may be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

A subterranean formation containing oil or gas hydrocarbons may be referred to as a reservoir, and may be land based or located off shore. Reservoirs are typically located in the range of a few hundred feet (shallow reservoirs) to a few tens of thousands of feet (ultra-deep reservoirs). To produce oil or gas or other fluids from the reservoir, a wellbore is drilled into a reservoir or adjacent to a reservoir.

A well can include, without limitation, an oil, gas, or water production well, or an injection well. As used herein, a "well" includes at least one wellbore having a wellbore wall. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet (30.5 m) of the wellbore. As used herein, "into a well" means and includes into any portion of the well, including into the wellbore or into the near-wellbore region via the wellbore.

A portion of a wellbore may be an open-hole or cased-hole. In an open-hole wellbore portion, a tubing string may be placed into the wellbore. The tubing string allows motive fluids to be introduced into or flowed from a remote portion of the wellbore. In a cased-hole wellbore portion, a casing is placed into the wellbore that can also contain a tubing string. A wellbore can also contain an annulus, such as, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

The system of the present disclosure will be specifically described below such that the system can be used to detect a wellbore or direct a drill bit in drilling a wellbore, such as a subsea well or a land well. However, it will be understood that the present disclosure is not limited to only drilling an oil well. The present disclosure also encompasses natural gas boreholes, other hydrocarbon boreholes, or boreholes in general. Further, the present disclosure may be used for the exploration and formation of geothermal boreholes intended to provide a source of heat energy instead of hydrocarbons.

This disclosure relates generally to surface tracking systems and methods. More particularly, this disclosure relates to systems and methods for tracking a wellbore or contents downhole within a wellbore such as a BHA, drill bit, or well testing device by measuring characteristics of a "gravity anomaly" in the subterranean formation. Such a gravity anomaly represents a deviation in a gravitational field caused by a change of properties within a local region of the subterranean formation. For example, the gravity anomaly may be due to a wellbore being drilled into the subterranean formation or due to changes to the contents within the wellbore. The gravity anomaly may also be due to adding or removing contents into the wellbore such as a fluid, a drillstring, or a well testing device. Still further, the gravity anomaly may be due to moving the contents within the wellbore either by physical displacement or by pumping through the wellbore. To measure the local changes to the gravitational field from the gravity anomaly, the surface tracking system includes one or more gravity sensors positioned at the surface of the wellbore. In an example, the gravity sensors may be quantum gravity sensors that provide resolution of micro-G to nano-G measurements. Although the disclosure describes the uses of quantum gravity sensors, other gravity sensors such as fiberoptic gravity sensors are also contemplated and may be used in combination with or as an alternative to quantum gravity sensors. Overall, the surface tracking systems disclosed have the ability to determine the positions of the wellbore and/or contents within the wellbore to a depth of up to and greater than 2,000 feet and in some instances up to 10,000 feet true vertical depth (TVD).

As described further herein the gravity anomaly may also be included in models of a subterranean formation, and the gravity profile from the model can be compared against the measurements of the gravity anomaly by the gravity sensors. In particular, the gravity anomaly measurements may be used as constraints for an "inversion algorithm" used to produce the model of the subterranean formation. The "inversion algorithm" is an iterative mathematical process by which sets of "input data" (measured, estimated, assumed, etc.) are used to produce a model of the subterranean formation. The model may be represented numerically or may be generated into a two or three-dimensional model of the subterranean formation. The inversion algorithm process uses one or more "governing equations" which interrelate the input data to the model. An inversion algorithm may start with an initial model of the subterranean formation, wherein the data describing the subterranean formation comprises, e.g., a number of strata layers, thicknesses of the strata layers, a density of each layer, the material comprising each layer, the porosity of the layers, and the properties of the materials filling the porosity within the layers. In an example, the initial model may be based on the number of strata layers, and a randomly assigned density value for each layer. Alternatively, rather than randomly assigned values, arbitrarily assigned values or predetermined values based on expectations, the initial model may be based on actual measured or observed data of the formation. The governing equations of the inversion algorithm use the input data and the model of the subterranean formation to produce simulated data (e.g., "modeled data") that represents properties of the subterranean formation. The accuracy of the modeled data can then be compared against measured data (e.g., "constraining measurements" that have not yet been used as input data) to assess the overall accuracy of the model including the accuracy of the input data. Without limitation, examples of constraining measurements comprise dimensional measurements of the well, densities within a well, seismic measurements from acoustic sensors, and gravity measurements from gravity sensors. If differences exist between the modeled data and the constraining measurements, one or more input data may be adjusted, and the inversion algorithm is run again. Successive iterations of adjusting the input data and running the inversion algorithm are used until the modeled data substantially matches the constraining measurements. On each iteration, the modeled data is compared against the constraining measurements. A model is described as converging when the modeled data is consistent with the constraining measurement (to within a threshold value). Without limitation, a typical convergent threshold value is reached when the change in value estimation is better than the corresponding noise level for the signals. Lower tolerances for convergence may be estimated by other means such as a formation model which does not change in depth estimation by more than the desired tolerance with which the bit location needs to be determined. Yet other convergence criteria may be set as an expectation based on experience such as but not limited to changes in parameter estimation lower than 1 percent. Alternatively, a model is described as divergent when the modeled data is inconsistent with the constraining measurement (to within a threshold value). Without limitation, a divergent threshold value is generally greater than at least 5 percent. However divergence and or convergence may be determined by model sensitivity analysis such as but not limited to a Monte Carlo sensitivity analysis (i.e., introducing a signal or other variable perturbations into the model to determine the effect on the model with respect to the required positional precision.

One way of improving model convergence and/or reduce the number of inversion algorithm iterations is to reduce the uncertainty of the input data by making direct measurements of input data property within the wellbore with sensors on the BHA. However, measurement uncertainty may still only limit the input data to a window of values. The absolute magnitude of the measurement is limited to the resolution and or accuracy of the sensor. In addition there is depth, lateral position, and positional uncertainty of the BHA that may be at times on the order of ten to several hundred feet. Thus, even direct measurements of input data may still only be known to within an experimental uncertainty window and numerical iteration may still be used to adjust the input data as the modeled data and constraining measurements converge.

In addition, the particular constraining measurements chosen may not correspond to a unique combination of input data and thus the model may have more than one solution convergence. In other words, more than one combination of inputs may satisfy the constraining measurements, and thus even the converged modeled data may not accurately represent the properties of the subterranean formation. For example, when the constraining measurements are seismic measurements from acoustic sensors on the surface, the same response may be measured by physically thick strata with high sound velocity and physically thin strata with low sound velocity (e.g., known in the art as velocity-depth ambiguity). Thus, a converged model may need to be compared with yet another constraining measurement to determine which of the converged models is an accurate representation of the subterranean formation. However, collecting additional constraining measurements to augment seismic measurements from surface is frequently not possible or practical because of legal or environmental restrictions. Downhole measurements may augment seismic information but come with an inherent ambiguity, resolution, and accuracy of those respective measurements. Such subsurface measurements may include wellbore acoustic, nuclear, electromagnetic, nuclear magnetic resonance, image, and formation test measurements. Additionally or alternatively, the constraining measurements for the model may be a gravity anomaly of known density and size that is introduced into the subterranean formation and measured by gravity sensors. As described further herein, the gravity profile modeled from the model may then be directly compared to the constraining measurement of the known gravity anomaly and a unique and convergent solution can be determined. By producing a converged model, the values of the input data are confirmed, and the modeled data of the model can more reliably be used.

In an example, the input data may comprise densities of the various strata, and thus the strata densities may be iteratively adjusted as input data into the inversion algorithm. On each iteration of strata density, a model is produced including modeled data that predicts a gravity profile of the subterranean formation. In addition, the gravity profile is modeled to include a "gravity anomaly" representing a change in a gravitational field. The gravity anomaly may for example represent a change due to a wellbore being added to the subterranean formation or due to changes within the wellbore (e.g., adding contents into the wellbore such as a drillstring or well testing device, moving the contents within the wellbore, pumping through wellbore, etc.). The gravity sensors mentioned above are used to detect the gravity profile both before and after the gravity anomaly and the changes in the measured gravity profile are thus attributable to the gravity anomaly. Gravity sensor measurements have a density-size-distance ambiguity such that changes of a gravitational field can be due to any combination of density, physical size, and distance from the gravity sensor. However, because the density and the physical size of the gravity anomaly are known in the case of an introduced gravity anomaly, the changes in the gravitational field are attributable to the distance. The distance between the gravity sensor and the gravity anomaly are then relatable to depth and/or position of the gravity anomaly depending on the quantity and arrangement of the gravity sensors, as described further herein. With the depth of the gravity anomaly measured by the sensors, the modeled gravity profile may be compared to the constraining measurement of the gravity anomaly depth and a unique and convergent solution can be determined using the inversion algorithm.

In some non-limiting aspects, the inversion algorithm may, for example, successively modify an initial model based on a gradient search technique, such as a Gauss-Newton search method. In an example, an inversion algorithm solution may be a one dimensional solution curve of density versus measurement depth. In some non-limiting aspects, the inversion algorithm may also generate a two dimensional solution curve of density versus measurement depth and or lateral position and or angular position about the wellbore. The model produced by the inversion algorithm may include, for example, modeled density data over distance or distance and angular position. The modeled data may thus include predictions of density at specific spatial positions within the subterranean formation and a prediction of a resulting gravity field at each specific spatial position. Without limitation, the modeled data and the measured data may be compared using a least-squares algorithm. A baseline gravity survey may be taken of before introduction of the wellbore or before extending a length of the wellbore, and the baseline gravity survey can be compared to a gravity survey after the wellbore is drilled further. The gravity survey may be conducted at multiple locations along the surface to better locate the position of the wellbore.

The inversion algorithm may be run using a number of different models and governing equations with initial sets of input data, each initial model leading to a new modeled data result which may be convergent or divergent (compared to the measured data). Multiple initial models may be run. In some non-limiting examples, hundreds of initial models may be used. For each model, the same or different number of strata may be used and the quantity of stratum (e.g., one, two, three, or any other discrete number) may also be varied as needed.

Without limitation, the inversion algorithm produced model may model data characterizing the properties of the subterranean formation in terms of density, material composition, strata or formation dimensions including thickness lateral extent and lateral variation, fluids such as water or oil and gas deposits, gravity profile, resistivity, nuclear measurements, and NMR measurements. Information may be obtained from the well being drilled and or offset wells for which the formation information is valid to the well being drilled or outcrops and include earth model information such as paleo environment. One example of paleo environment informing is the positon of a water type environment (e.g., shole, island, beach, bay, delta, and the direction of sedimentation.) Such information may provide information about lateral extent variations of stratigraphic density.

Referring to FIG. 1, a drilling system 101 is shown with a wellbore 102 that extends from a wellhead 104 into a subterranean formation 106 from a surface 108. Generally, the wellbore 102 may include horizontal, vertical, slanted, curved, and other types of wellbore geometries and orientations. The wellbore 102 may be cased or uncased. In examples, the wellbore 102 includes a metallic member. By way of example, the metallic member may be a casing, liner, tubing, or other elongated steel tubular disposed in the wellbore 102.

As illustrated, the wellbore 102 extends through the subterranean formation 106. As illustrated in FIG. 1, the wellbore 102 extends generally vertically into the subterranean formation 106, however the wellbore 102 may alternatively extend at an angle through the subterranean formation 106, such as horizontal and slanted wellbores 102. For example, although FIG. 1 illustrates a vertical or low inclination angle well, high inclination angle or horizontal placement of the wellbore 102 and equipment is possible. It should be further noted that while FIG. 1 generally depicts land-based operations, those skilled in the art will recognize that without departing from the scope of the disclosure, the principles described herein are equally applicable to subsea operations that employ floating or sea-based platforms and rigs.

As illustrated in FIG. 1, a drilling platform 110 supports a derrick 112 having a traveling block 114 for raising and lowering a drillstring 116. The drillstring 116 may comprise, but is not limited to drill pipe as generally known to those skilled in the art. A kelly 118 supports the drillstring 116 as it is lowered through a rotary table 120. A drill bit 122 attaches to the distal end of the drillstring 116 and is driven by either by a downhole motor (not shown) and/or via rotation of the drillstring 116 from the surface 108. Without limitation, the drill bit 122 may include, roller cone bits, PDC bits, natural diamond bits, any hole openers, reamers, coring bits, and the like. As the drill bit 122 rotates, the wellbore 102 extends into and penetrates various subterranean formations 106 and stratigraphic features 107. A pump 124 circulates drilling fluid through a feed pipe 126 through the kelly 118, downhole through an interior of the drillstring 116, through orifices in the drill bit 122, back to the surface 108 via an annulus 128 surrounding the drillstring 116, and into a retention pit 132.

Referring still to FIG. 1, drill pipe of the drillstring 116 begins at the wellhead 104 and traverses the wellbore 102. The drill bit 122 attaches to a distal end of the drillstring 116 and may be driven, for example, either by a downhole motor (not shown) and/or via rotation of the drillstring 116 from the surface 108. The drill bit 122 may be part of a bottom hole assembly (BHA) 130 at a distal end of the drillstring 116. It should be noted that the BHA 130 may also be referred to as a downhole tool. The BHA 130 may further include tools for look-ahead resistivity applications. As will be appreciated by those of ordinary skill in the art, the BHA 130 may be a measurement-while drilling (MWD) or logging-while-drilling (LWD) system. The BHA 130 may also include measuring equipment and directional drilling rotary steerable systems such as a push-the-bit or point-the-bit systems.

The BHA 130 may comprise any number of tools, transmitters, and/or receivers to perform downhole measurement operations. For example, as illustrated in FIG. 1, the BHA 130 includes a measurement assembly 134. Without limitation, any number of different measurement assemblies, communication assemblies, battery assemblies, and/or the like may form the BHA 130 with the measurement assembly 134. Additionally, the measurement assembly 134 may form the BHA 130 itself. In examples, the measurement assembly 134 comprises at least one transducer 136, which may be disposed at the surface of the measurement assembly 134. Without limitation, the transducers 136 may also be located within the measurement assembly 134. Without limitation, there may be four transducers 136 arranged ninety degrees from each other around the BHA 130. However, it should be noted that there may be any number of transducers 136 disposed along the BHA 130 at any degree from each other. Without limitation, the transducers 136 may be made of piezo-ceramic crystals, or optionally magnetostrictive materials or other materials that generate an acoustic pulse when activated electrically or otherwise. In examples, the transducers 136 also include backing materials and matching layers. It should be noted that the transducers 136 and assemblies housing the transducers 136 may be removable and replaceable, for example, in the event of damage or failure. In examples, the BHA 130 includes one or more additional components, such as analog-to-digital converter, a filter and an amplifier, among others, that may be used to process the measurements of the BHA 130 before they are transmitted to the surface 108.

As an example, the transducers 136 function and operate to generate an acoustic pulse that travels through wellbore fluids. The transducers 136 further sense and acquire the reflected acoustic wave, which is modulated (i.e., reflected as an echo) by the wellbore 102 wall. During measurement operations, the travel time of the pulse wave from transmission to recording of the echo is recorded. Based on the speed of sound within the fluid of the wellbore 102, the echo time is used to determine physical dimensions such as a diameter of the wellbore 102. By analyzing the amplitude of the echo signal, the acoustic impedance may also be derived.

Referring still to FIG. 1, the surface tracking system 100 comprises an information handling system 138 including a computer 141, a video display 142, a keyboard 144 (i.e., other input devices.), and/or non-transitory computer-readable media 146 (e.g., optical disks, magnetic disks) that can store code representative of the methods described herein. As illustrated, the information handling system 138 is disposed at the surface 108 and transmits and receives data with the BHA 130 and with one or more gravity sensors 148 via one or more communication links 140 (which may be wired or wireless, for example). Optionally, the information handling system 138 may communicate with the BHA 130 through a communication line (not illustrated) disposed in (or on) the drillstring 116. In examples, wireless communication may be used to transmit information back and forth between the information handling system 138 and the BHA 130 and between the information handling system 138 and the gravity sensor(s) 148.

The information handling system 138 processes information recorded by the BHA 130 and transmitted to the surface 108. Additionally, and as described further herein, the information handling system 138 also processes information from the gravity sensor(s) 148 to create a model characterizing the subterranean formation 106 and track the trajectory of the wellbore 102.

Although the information handling system 138 is positioned at the surface 108 in the example of FIG. 1, the information handling system 138 may also be positioned downhole in the BHA 130 and processing may occur downhole. Without limitation, a downhole information handling system may include a microprocessor or other suitable circuitry for estimating, receiving, and processing signals from the BHA 130 and/or the gravity sensor(s) 148. The information handling system 138 may further include additional components, such as memory, input/output devices, interfaces, and the like.

Any suitable technique may be used for transmitting signals from the BHA 130 to the surface 108, including, but not limited to, wired pipe telemetry, mud-pulse telemetry, acoustic telemetry, and electromagnetic telemetry. While not shown, the BHA 130 may include a telemetry assembly that transmits telemetry data to the surface 108 as signals. At the surface 108, transducers (not shown) may convert the telemetry signals into electrical signals for a digitizer (not shown). The digitizer may supply a digital form of the telemetry signals to the information handling system 138 via the communication link 140 for processing by the information handling system 138. Although not shown, one of ordinary skill in the art will appreciate the aspects of including the telemetry assembly in the BHA 130 as well as the digitizer.

The gravity sensors 148 measure a gravitational field about the gravity sensor in all directions 148 thus may be used to determine the position of a gravity anomaly such as a position of the wellbore 102. The gravity sensor(s) 148 may include, for example, quantum gravity sensors, fiberoptic gravity sensors, or combinations thereof. The gravity sensor(s) 148 are placed at locations at the surface 108 and may be spaced for optimal ranging of the drill bit 122. Generally speaking, each gravity sensor 148 has an approximate hemispherical shaped region (e.g., a "detection window") beneath the gravity sensor 148 where changes in the gravitational field are detectable. The shape of detection depends on the local gravity fluctuations about the gravity sensor 148. The mass above and beside the gravity sensor 148 may be also determined if not negatable. Depending on the required sensitivity of the analysis, the mass due to the atmosphere may also be accounted for. Thus, the spacing between gravity sensors 148 may be selected so that the detection windows between adjacent gravity sensors 148 overlap. Multiple gravity sensors 148 may be used, or a single gravity sensor 148 that is moved to different positons, as described further herein. At least one gravity sensor 148 positional measurement is used but preferably two or more gravity sensor 148 position measurements at the surface 108 are preferable. Further three or more gravity sensors 148 are preferable. In an example ranging use, a gravity sensor 148 is positioned at the surface 108, proximate the wellbore 102, and monitors the distance to the drill bit 122. In the presence of a well-defined stratigraphic earth model, one gravity sensor 148 measurement at a measurement location may be sufficient to determine distance, however multiple sensor measurement locations are preferable.

During operation of the drill bit 122, the length of the wellbore 102 is extended and the position of the drill bit 122 changes. The gravity sensor 148 makes measurements of a gravity field around the drill bit 122 before extending the length of the wellbore 102 (e.g., an "initial survey") and makes measurements of the gravity field after extending the length of the wellbore 102 (e.g., a "secondary survey"). The initial survey and the secondary survey are compared by the information handling system 138 and the difference between the surveys represents the gravity anomaly due to the additional wellbore 102 length. Generally speaking, gravity measurements by the gravity sensors 148 have a density-size-distance ambiguity such that changes of a gravitational field can be due to any combination of density, physical size, and distance from the gravity sensor 148. However, because the density and the physical size of the wellbore 102 and/or the contents within the wellbore 102 (e.g., the drillstring 116, drill bit 122, drilling mud, etc.) are known, the changes in the gravitational field are attributable to the depth of the gravity anomaly. As one embodiment of modeling, the relationship $F=Gm1m2/R^2$ (relativity may be neglected) where F is the force of gravitational attraction between mass 1 and mass 2, G is the universal gravitational constant, m1 is mass 1, m2 is mass 2, and R is a distance between mass 1 and mass 2. In this fashion, the subsurface may be divided into finite elements each with a volume such that a density within that volume describes the mass of that volume. The composite force due to all subsequent volumes acting on the gravity sensor 148, sensing mass at each location, provides the distance R to be determined and hence the location of the wellbore 102 is determined.

When using only one gravity sensor 148, the position of the gravity anomaly is known the be within the dimensionally known detection window of the gravity sensor, so the position and orientation of the gravity sensor 148 relative to the wellhead 104 position can be used to geometrically calculate a range of gravity anomaly depths. Depending on the dimensional size of the detection window for the gravity sensor 148, uncertainty in the absolute depth may exist because the distance from the gravity sensor 148 defines an uncertainty region for which the wellbore 102 may be located rather than a singular discrete point. Thus, axillary measurements (e.g., ordinal direction of the wellbore 102, the wellbore 102 length, etc.) may also be used to refine the gravity anomaly depth and position calculation. For example, the axillary measurement of wellbore 102 direction may define a narrowed down segment of the uncertainty region and thus and narrowed range of gravity anomaly depths.

In an example, two gravity sensors 148 may be used to improve the accuracy of the depth calculation for the gravity anomaly. The placement of the two gravity sensors 148 can be chosen such that the detection windows overlap so that the gravity anomaly is detectable by both gravity sensors 148. The distance between each gravity sensor 148 and the gravity anomaly are measured as previously described, however uncertainty in the absolute depth is reduced by comparing the signals from both gravity sensors 148. For example, if each gravity sensor 148 defines an uncertainty region of distances, the overlap between two uncertainty regions defines a smaller geographic region of distance and thus less calculated depth uncertainty.

Still further, the use of three gravity sensors 148 allows a triangulation of the gravity anomaly when the placement of the gravity sensors 148 allows for overlapping detection windows. For example, if each gravity sensor 148 defines an uncertainty region of distances between each gravity sensor 148 and the gravity anomaly, the overlap between three uncertainty regions defines a particular and discrete point. Thus, the depth of the discrete point for the gravity anomaly can be calculated.

Note that so long as the wellbore 102 does not significantly change between sequential readings, a single gravity sensor 148 may be moved between a series of sequential positions to take measurements. Thus, the gravity sensor(s) 148 may remain stationary or may be moved throughout the ranging process, although the gravity sensor(s) 148 should be fixed during the measurements. In this manner, one or more gravity sensors 148 may be used to simulate surface tracking systems 100 including additional gravity sensors 148. For instance a single gravity sensor 148 may be moved to a second location or a third location to make the equivalent measurements of a two or three gravity sensor 148 surface tracking system 100.

Although example uses and arrangements of the gravity sensors 148 are described with respect to drilling the wellbore 102, a detectable gravity anomaly may also be produced by other changes within the wellbore 102. In addition, an existing or previously measured gravity anomaly may also be "enhanced" by further changes to the gravitational field of the wellbore 102 or contents within the wellbore 102. Additionally, differences between the initial survey and the secondary survey may also be continuously calculated by the information handling system 138 so that the change in the gravity anomaly can be examined as a function of time. As described below, the frequency of changes of the gravity anomaly may be used to accurately identify the gravity anomaly.

Referring still to FIG. 1, gravity anomalies can also be created or enhanced by sequentially extending and retracting a position of contents within the wellbore 102. For example, the drillstring 116 position can be sequentially varied and thus cause a variation in the gravitational field at the distal end of the drill bit 122. The extending and retracting of the drill bit 122 may be achieved by manipulating the drillstring 116 from the surface and/or may be achieved as a natural result of tripping into and out of the wellbore 102 during drilling operations. As such, a gravity survey by the surface tracking system 100 may be timed with tripping activities. Because the extension or retraction rate of the drillstring 116 are known, the rate of change of the gravity anomaly may be measureable by the information handling system 138, and thus may be used to readily identify the location of the gravity anomaly apart from other potential gravity profile changes (e.g., "background noise"). For example, the frequency of the sequential extension and retraction of the drillstring 116 could be set to a particular frequency that is readily distinguishable from the background noise and the information handling system 138 could be configured to monitor for gravity anomalies at that set frequency. With sequential extension and retraction of the drillstring 116 position, it is anticipated that the position of the drill bit 122 would result in the largest enhancement to the gravity anomaly signal. The drill bit 122 would periodically occupy a particular position and then not occupy that position and thus would produce the largest magnitude gravity anomaly along the wellbore 102. However, gravity anomalies may also be enhanced at other positions along the wellbore 102 or the drillstring 116. For example, gravity anomalies may be enhanced at a plurality of positions along the wellbore 102 and the measurements of the gravity anomalies may be conducted when tripping in and tripping out of the wellbore 102 with the BHA 130.

Figure 2:
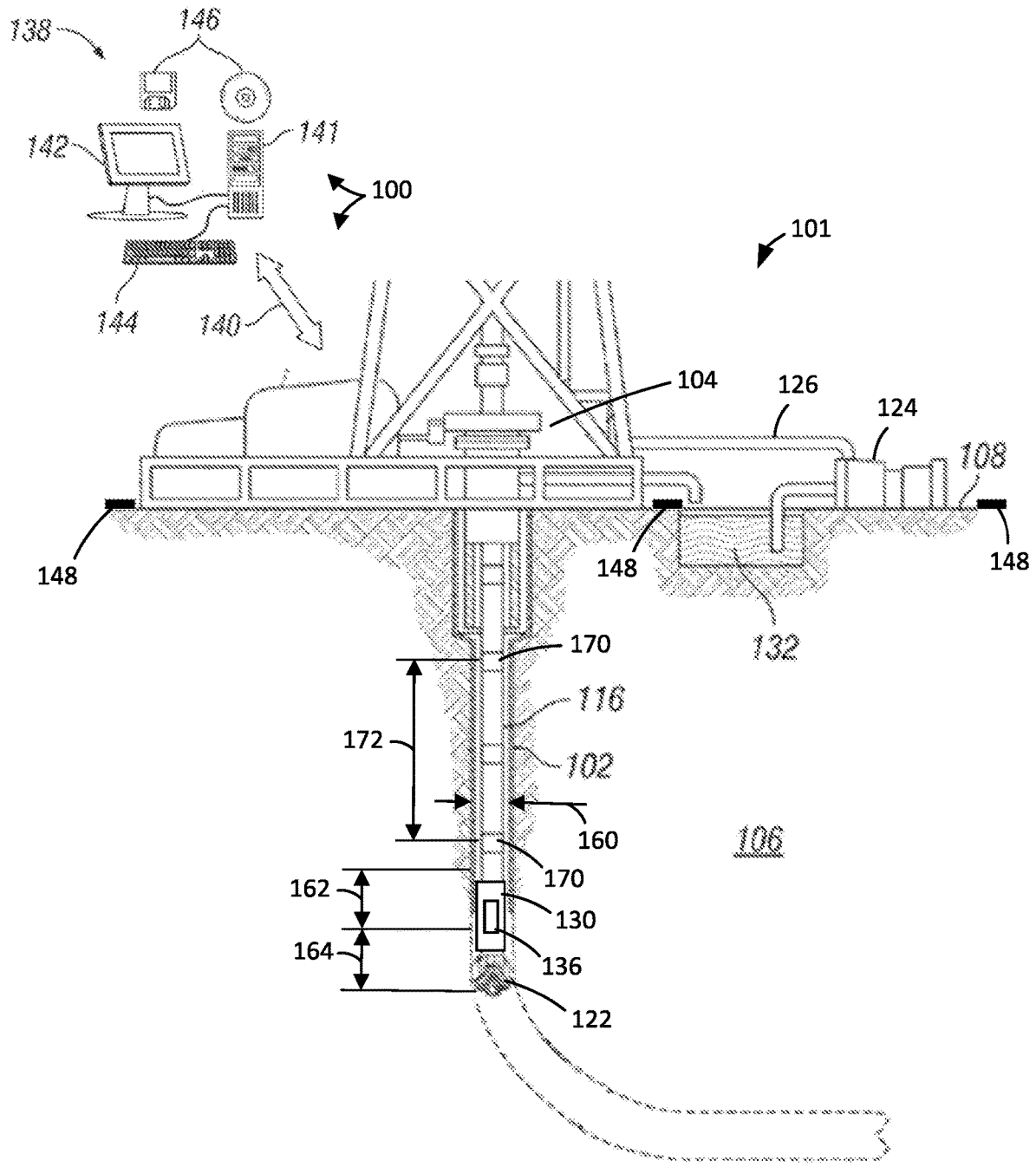
FIG. 2 illustrates the surface tracking system of FIG. 1 in more detail.

Referring to FIG. 2, gravity anomalies can also be created or enhanced by introducing low density pills 170 within the wellbore 102. In the example of FIG. 2, the low density pills 170 are fluid or drilling mud with a minimum density to provide wellbore 102 stability and are designed to be compatible with the mud system. Low density pills 170 are fluids of lower density than the surrounding fluids, but are limited to a small region in the flow of the mud system. A higher density mud may be used outside the region of the low density pill 170 to increase the contrast while circulating. The low density pill 170 should maintain its integrity while the mud system is circulating. The integrity of the low density pill 170 can be increased by adding viscosifiers (e.g., to increase the lubricity or viscosity) and or higher surface tension material. The low density pills 170 are introduced into the drillstring 116 at known intervals and pumped downhole within the wellbore 102. The flow rate of the drilling mud is established by the operational parameters of the pump 124 and so the introduction of the low density pills 170 at a known intervals will coincide with a known distance between the sequentially introduced low density pills 170. The known introduction interval will thus also produce a known frequency of the gravity anomaly change as the low density pills 170 flow past a particular position within the drillstring 116. The known distance between two of the low density pills 170 is shown as a distance 172. The distance 172 can thus be included in the model created by the inversion algorithm, the gravity profile may be modeled, and the gravity profile may be constrained against the gravity anomaly measured by the information handling system 138. The known distance 172 and the known densities of the low density pills 170 thus allow the depths of the low density pills 170 to be calculated by the information handling system 138. Also, because the frequency of the low density pills 170 passing by a set position is known, the rate of change of the gravity anomaly may be readily identified apart from other potential background noise that would be at a different frequency.

Referring still to FIG. 2, gravity anomalies can also be created or enhanced by drilling the wellbore 102 at two different rates over two different lengths shown as distances 162 and 164. The magnitude of the distances 162, 164 may be the same or different, and thus "different" simply refers to different locations along the wellbore 102. In addition, while the locations of distances 162, 164 are adjacent in the example of FIG. 2, the locations of the distances 162, 164 may also be separated along the length of the wellbore 102.

During operations of the drilling system 101, an initial gravity survey can be performed before the drill bit 122 extends the length of the wellbore 102 within the distances 162, 164. The drill bit 122 can then extend the wellbore 102 length along the distance 162. A secondary gravity survey can then be performed to detect the gravity anomaly along the distance 162. The drill bit 122 can then be made to increase the drilling rate (e.g., by increasing weight on the drill bit 122, increasing the rotational rate of the drill bit 122, or combinations thereof) and the wellbore 102 length may be extended along the distance 164. Another secondary gravity survey can then be performed to detect the gravity anomaly along the distance 164. The gravity anomalies from the distance 162 is expected to be of a smaller magnitude that the gravity anomaly from the distance 164 and thus the sequence of gravity anomalies form a pattern that may be readily identified apart from other potential background noise. In this manner the signal representative of the gravity anomaly can be described as enhanced by drilling the wellbore 102 at two different rates over two different lengths (e.g., distances 162, 164).

Figure 3:
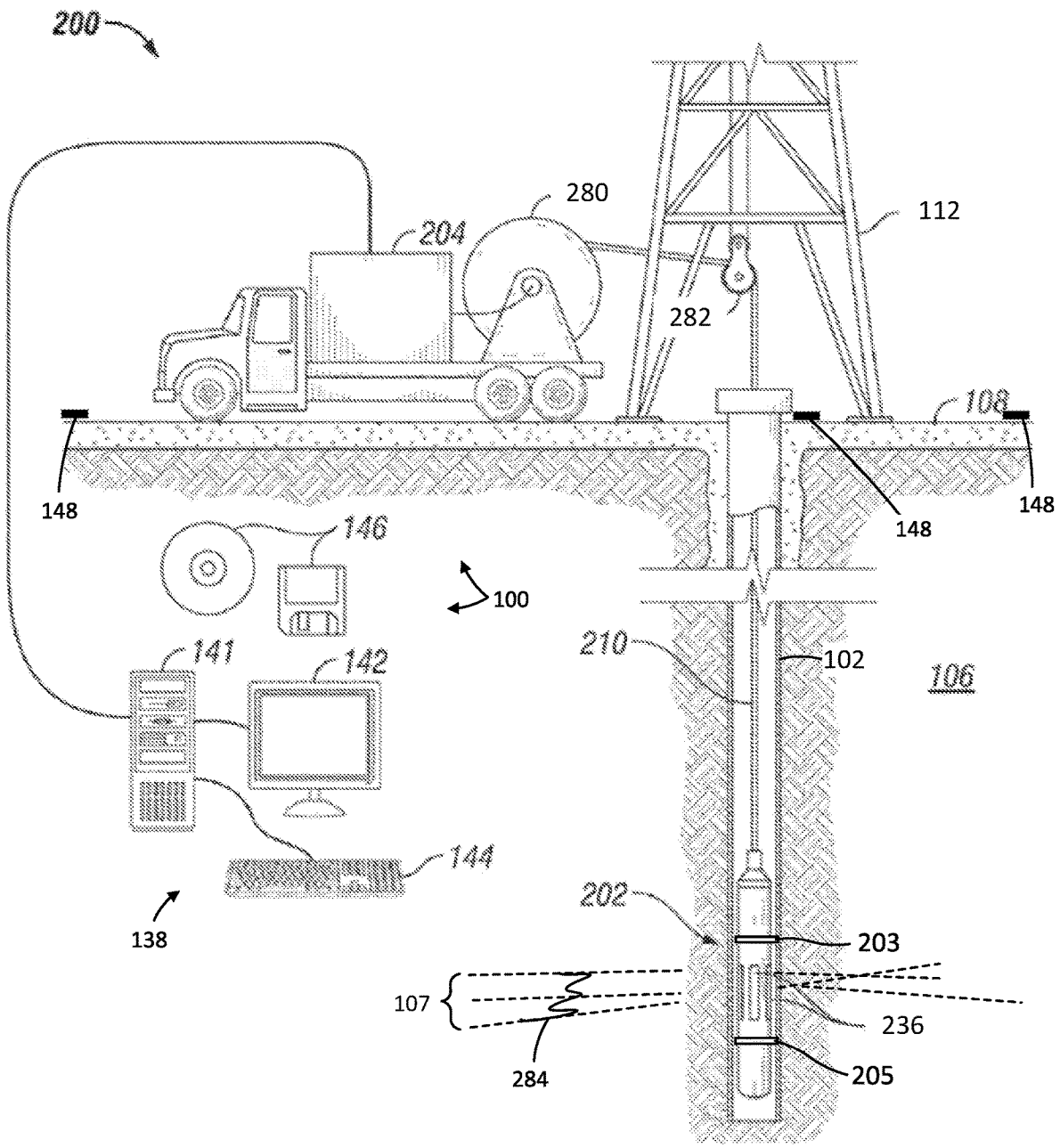
FIG. 3 illustrates an example surface tracking system in accordance with the present disclosure as used with a wireline formation evaluation system.

Referring to FIG. 3, a formation evaluation system 200 is shown that may be used to measure properties of the subterranean formation 106 and/or collect fluid samples from the subterranean formation 106 for surface measurements. The surface measurements may be used to characterize the subterranean formation 106 and fluids within the subterranean formation. Measurements from the formation evaluation system 200 may serve as input data into the inversion algorithm as the model and modeled data is produced. In addition, because a well testing device 202 of the formation evaluation system 200 is introduced as contents within the wellbore 102, the surface tracking system 100 may also be used to track the position of the well testing device 202. Still further, the formation evaluation system 200 may be configured to flow fluids through an interface of the wellbore 102, thus changing density of the well testing device 202 and creating or enhancing a gravity anomaly.

As illustrated in the example of FIG. 3, the formation evaluation system 200 includes the well testing device 202 attached to a vehicle 204. However, it should be appreciated that the well testing device 202 may alternatively be supported by the derrick 112. In the example shown, the well testing device 202 is tethered to the vehicle 204 through a conveyance 210 disposed around a spool 226 and one or more sheave wheels 282. The conveyance 210 may include any suitable means for providing mechanical conveyance for the well testing device 202, including, but not limited to, wireline, slick line, coiled tubing, pipe, drill pipe, downhole tractor, or the like. In some embodiments, the conveyance 210 may provide mechanical suspension, as well as electrical and/or optical connectivity, for the well testing device 202.

Without limitation, the well testing device 202 may comprise a drill stem tester or a formation tester, and may characterize the subterranean formation 106, for example in terms of fluid density, permeability, or formation pressures. The well testing device 202 may comprise transducers 236 (similar to the transducers 136 previously described) that can measure properties such as density. Without limitation, the well testing device 202 may optionally comprise passages for formation fluids to pass through the well testing device 202, through the conveyance 210, and to the vehicle 204 for testing at the surface 108. Without limitation, the well testing device 202 may optionally comprise internal chambers for the storage of formation fluids as the well testing device 202 is retrieved from the wellbore 102. Still further, the well testing device may further comprise an upper packer 203 and a lower packer 205 that are used above and below a sampling region of the well testing device 202. In this manner, the packers 203, 205 may be used to isolate particular portions of the wellbore 102 and thus allow sampling from particular locations of the subterranean formation 106.

The surface tracking system 100 using the gravity sensor(s) 148 may be used to track the position of the well testing device 202 during deployment into the wellbore 102. The dimensions and density of the well testing device 202 are known and thus the depth and position within the wellbore 102 can be monitored in the manner previously described from tripping into and out of the wellbore 102 with the drillstring 116. Thus the surface tracking system 100 can be used to target a particular location of interest for the well testing device 202 within the subterranean formation 106. In addition, the well testing device 202 may be configured to flow fluid through an interface of the wellbore 102 (e.g., through the wall of the wellbore 102 via perforations into the subterranean formation 106). The fluids may be injected into the subterranean formation 106 or may be produced into the well testing device 202. In an example, the fluids produced into the well testing device 202 are from a finger 284 of an injection front as shown in FIG. 3 between two fluids such as oil and water that interact to create an uneven or non-uniform flow path through the subterranean formation 106.

As fluid passes into or out of the wellbore 102 via the well testing device 202, the density of the well testing device 202 increases or decreases by a known or measurable amount. Fluids flowed from the well testing device 202 have known densities, while fluids flowing into the well testing device 202 have measurable densities. In each instance, the known density change results in a created or enhanced gravity anomaly at the location of the well testing device 202 and the surface tracking system 100 may be used to track the position of the well testing device 202.

Overall, by using the surface tracking system 100 to detect gravity anomalies in the manner described, the position and trajectory of the wellbore 102 and/or contents within the wellbore 102 may be more accurately measured. As a result of the accurate positional measurements, the model of the subterranean formation 106 can be more accurately produced as the modeled data is confirmed to converge with the constraining measurements from the surface tracking system 100. A model with increased accuracy provides a more accurate characterization of the subterranean formation 106 and allows for improved imaging of fluids within the subterranean formation 106 including but not limited to fluid type, fluid weigh (for example API gravity), fluid contacts, fluid migration (natural or induced), preferential flow paths of fluids, and fluid fronts.

During drilling, the converged model and surface tracking system 100 may be used for geosteering the drill bit 122 as the gravity sensors 148 provide quantitative real-time data for decision making. For example, the gravity sensors 148 can measure the position and trajectory of the drill bit 122 relative to the stratigraphic features 107 of a target formation and can then provide feedback to the steering systems to guide the drill bit 122 within the target formation. The ability to track and guide the drill bit 122 when using the surface tracking system 100 is not dependent on the wellbore 102 total length. Rather, the ability to track and guide the drillstring 116 depends on: the total vertical depth (TVD) of the wellbore 102; the accuracy, placement, and number of gravity sensors 148; and on the subterranean formation 106 properties between the wellbore 102 and the surface 108. Thus, the surface tracking system 100 provides an improved steering and tracking system for use with relatively deep and or long horizontal wellbores 102 where the positional uncertainty (e.g., "uncertainty cone") is quite large near the end of the wellbore 102.

Still further, the surface tracking system 100 may be used during sampling or production operations to track the position of the well testing device 202 within the wellbore 102. As previously described, when introduced into the wellbore 102, the well testing device 202 results in a gravity anomaly that is detectable by the surface tracking system 100. Known dimensional and density information about the well testing device 202 allows the density-size-distance ambiguity of the gravity measurements to be resolved, and the distance to the well testing device 202 to be calculated. The position of the well testing device 202 can then be represented in the model of the subterranean formation 106 relative to stratigraphic features 107.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed.

In addition to the embodiments described above, many examples of specific combinations are within the scope of the disclosure, some of which are detailed below:

Example 1 A method of determining a wellbore position in a subterranean formation, the method comprising:

- detecting a gravity anomaly using a gravity sensor positioned at a surface above the wellbore, wherein the gravity anomaly is a deviation in a gravitational field related to a presence of the wellbore or contents within the wellbore;
- creating a model of the subterranean formation with an inversion algorithm using input data related to properties of the subterranean formation, wherein the inversion algorithm uses governing equations and the input data to produce modeled data;
- predicting a gravity profile from the modeled data including the gravity anomaly;
- constraining the inversion algorithm with a depth of the gravity anomaly as calculated with at least one of a known dimension or a known gravitational field change related to the gravity anomaly; and
- determining the wellbore position with the model by changing the input data until the gravity profile converges with the gravity anomaly.

Example 2 The method of Example 1, further comprising steering a direction of a drill bit during drilling of the wellbore based on the determined wellbore position within the model.

Example 3 The method of Example 1, further comprising measuring the input data comprising at least one of formation density or formation fluid density with a sensor on a bottom hole assembly (BHA).

Example 4 The method of Example 1, wherein the contents within the wellbore comprise a drillstring, wherein detecting the depth of the gravity anomaly further includes sequentially extending and retracting the drillstring within the wellbore to adjust a density of the contents within the wellbore at the drillstring position.

Example 5 The method of Example 1, further comprising:

flowing a plurality of low density pills through the wellbore, wherein the low density pills are separated by a known distance interval; and using the known distance interval as the known dimension when constraining the model.

Example 6 The method of Example 1, wherein the constraining the inversion algorithm comprises using density information of the contents within the wellbore.

Example 7 The method of Example 6, wherein the contents within the wellbore comprises a drillstring with a known density and wherein the known dimension is a dimension of the drillstring, and wherein the constraining the inversion algorithm comprises using both the known dimension and the know density to determine the depth of the gravity anomaly.

Example 8 The method of Example 1, wherein the contents within the wellbore comprises a drillstring and detecting the depth of the gravity anomaly further comprises creating the gravity anomaly by drilling the wellbore.

Example 9 The method of Example 8, wherein creating the gravity anomaly comprises drilling the wellbore at two different rates over two different lengths.

Example 10 A method of determining a wellbore position in a subterranean formation, the method comprising:

detecting a gravity anomaly using a gravity sensor positioned at a surface above the wellbore, wherein the gravity anomaly is a deviation in a gravitational field related to a presence of the wellbore and a fluid flowing through an interface of the wellbore;

creating a model of the subterranean formation with an inversion algorithm using input data related to properties of the subterranean formation, wherein the inversion algorithm uses governing equations and the input data to produce modeled data;

predicting a gravity profile from the modeled data including the gravity anomaly;

constraining the inversion algorithm with a depth of the gravity anomaly as calculated with a known dimension of the wellbore and a known gravitational field deviation related to the gravity anomaly; and determining the wellbore position with the model by changing the input data until the gravity profile converges with the gravity anomaly.

Example 11 The method of Example 10, wherein the flowing of the fluid through the interface of the wellbore is formed as a finger from an injection front.

Example 12 The method of Example 10, wherein the flowing of the fluid through the interface of the wellbore is one of injected and produced from a drill stem tester or a formation tester.

Example 13 A surface tracking system for determining a wellbore position in a subterranean formation, the surface tracking system comprising:

a gravity sensor positioned at a surface above the wellbore and configured to detect a gravity anomaly, wherein the gravity anomaly is a deviation in a gravitational field related to a presence of the wellbore or contents within the wellbore; and an information handling system operable to:

create a model of the subterranean formation with an inversion algorithm using input data related to properties of the subterranean formation, wherein the inversion algorithm uses governing equations and the input data to produce modeled data;

predict a gravity profile from the modeled data including the gravity anomaly;

constrain the inversion algorithm with a depth of the gravity anomaly as calculated with at least one of a known dimension or a known gravitational field change related to the gravity anomaly; and determine the wellbore position with the model by changing the input data until the gravity profile converges with the gravity anomaly.

Example 14 The surface tracking system of Example 13, further configured to steer a direction of a drill bit during drilling of the wellbore based on the determined wellbore position within the model.

Example 15 The surface tracking system of Example 13, further comprising a sensor on a bottom hole assembly (BHA), wherein the sensor is operable to measure the input data comprising at least one of formation density or formation fluid density.

Example 16 The surface tracking system of Example 13, wherein the contents within the wellbore comprises a drillstring, and wherein the signal to the information handling system is enhanced by sequentially extending and retracting the drillstring within the wellbore to adjust a density of the contents within the wellbore at the drillstring position.

Example 17 The surface tracking system of Example 13, wherein:

the signal to the information handling system is enhanced by flowing a plurality of low density pills through the wellbore, wherein the low density pills are separated by a known distance interval; and the information handling system is further operable to use the known distance interval as the known dimension when constraining the model.

Example 18 The surface tracking system of Example 13, wherein the gravity anomaly relates to a known change of density of the contents within the wellbore.

Example 19 The surface tracking system of Example 18, wherein the contents within the wellbore comprises a drillstring with a known density and wherein the known dimension is a dimension of the drillstring, and wherein the information handling system is further operable to constrain the inversion algorithm using both the known dimension and the know density to determine the depth of the gravity anomaly.

Example 20 The surface tracking system of Example 13, wherein the signal is enhanced by drilling the wellbore.

Example 21 The surface tracking system of Example 20, wherein the signal is enhanced by drilling the wellbore at two different rates over two different lengths.

One or more specific embodiments of the present disclosure have been described. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Certain terms are used throughout the description and claims to refer to particular features or components. As one skilled in the art will appreciate, different persons may refer to the same feature or component by different names. This document does not intend to distinguish between components or features that differ in name but not function.

For the embodiments and examples above, a non-transitory computer readable medium can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

Reference throughout this specification to "one embodiment," "an embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A method of steering a direction of a drill bit during drilling of a wellbore in a subterranean formation, the method comprising:

detecting a gravity anomaly using a gravity sensor positioned at a surface above the wellbore, wherein the gravity anomaly is a deviation in a gravitational field related to a presence or change of contents within the wellbore, wherein the contents within the wellbore comprise a drillstring;

creating a model of the subterranean formation with an inversion algorithm using input data related to properties of the subterranean formation, wherein the inversion algorithm uses governing equations and the input data to produce modeled data;

predicting a gravity profile from the modeled data including the gravity anomaly;

constraining the inversion algorithm with a depth of the gravity anomaly as calculated with at least one of a known dimension or a known gravitational field change related to the gravity anomaly;

detecting the depth of the gravity anomaly further comprises creating the gravity anomaly by drilling the wellbore;

determining a wellbore position with the model by changing the input data until the gravity profile converges with the gravity anomaly; and steering the direction of the drill bit between vertical and at least horizontal to guide the drill bit to a target formation during drilling of the wellbore based on the determined wellbore position.

2. The method of claim 1, further comprising measuring the input data comprising at least one of formation density or formation fluid density with a sensor on a bottom hole assembly (BHA).

3. The method of claim 1, wherein detecting the depth of the gravity anomaly further includes sequentially extending and retracting the drillstring within the wellbore to adjust a density of the contents within the wellbore at the drillstring position.

4. The method of claim 1, further comprising:

flowing a plurality of low density pills through the wellbore, wherein the low density pills are separated by a known distance interval; and using the known distance interval as the known dimension when constraining the model.

5. The method of claim 1, wherein the constraining the inversion algorithm comprises using density information of the contents within the wellbore.

6. The method of claim 5, wherein the drillstring has a known density and wherein the known dimension is a dimension of the drillstring, and wherein the constraining the inversion algorithm comprises using both the known dimension and the know density to determine the depth of the gravity anomaly.

7. The method of claim 1, wherein creating the gravity anomaly further comprises drilling the wellbore at two different rates over two different lengths.

8. A method of steering a direction of a drill bit during drilling of a wellbore in a subterranean formation, the method comprising:

detecting a gravity anomaly using a gravity sensor positioned at a surface above the wellbore, wherein the gravity anomaly is a deviation in a gravitational field related to a presence or change of contents within the wellbore, wherein the contents comprise a drillstring and a fluid flowing through an interface of the wellbore;

creating a model of the subterranean formation with an inversion algorithm using input data related to properties of the subterranean formation, wherein the inversion algorithm uses governing equations and the input data to produce modeled data;

predicting a gravity profile from the modeled data including the gravity anomaly;

constraining the inversion algorithm with a depth of the gravity anomaly as calculated with a known dimension of the wellbore and a known gravitational field deviation related to the gravity anomaly;

detecting the depth of the gravity anomaly further comprises creating the gravity anomaly by drilling the wellbore;

determining a wellbore position with the model by changing the input data until the gravity profile converges with the gravity anomaly; and steering the direction of the drill bit between vertical and at least horizontal to guide the drill bit to a target formation during drilling of the wellbore based on the determined wellbore position.

9. The method of claim 8, wherein the flowing of the fluid through the interface of the wellbore is formed as a finger from an injection front.

10. The method of claim 8, wherein the flowing of the fluid through the interface of the wellbore is one of injected and produced from a drill stem tester or a formation tester.

11. A surface tracking system for steering a direction of a drill bit during drilling of a wellbore in a subterranean formation, the surface tracking system comprising:

a gravity sensor positioned at a surface above the wellbore and configured to detect a gravity anomaly, wherein the gravity anomaly is a deviation in a gravitational field related to a presence or change of contents within the wellbore, wherein the contents comprise a drillstring; and an information handling system operable to:

create a model of the subterranean formation with an inversion algorithm using input data related to properties of the subterranean formation, wherein the inversion algorithm uses governing equations and the input data to produce modeled data;

predict a gravity profile from the modeled data including the gravity anomaly;

constrain the inversion algorithm with a depth of the gravity anomaly as calculated with at least one of a known dimension or a known gravitational field change related to the gravity anomaly;

determine a wellbore position with the model by changing the input data until the gravity profile converges with the gravity anomaly; and steer the direction of the drill bit between vertical and at least horizontal to guide the drill bit to a target formation during drilling of the wellbore based on the determined wellbore position, wherein a signal to the information handling system is enhanced by sequentially extending and retracting the drillstring within the wellbore to adjust a density of the contents within the wellbore at the drillstring position.

12. The surface tracking system of claim 11, further configured to steer a direction of the drill bit during drilling of the wellbore based on the determined wellbore position.

13. The surface tracking system of claim 11, further comprising a sensor on a bottom hole assembly (BHA), wherein the sensor is operable to measure the input data comprising at least one of formation density or formation fluid density.

14. The surface tracking system of claim 11, wherein:

the signal to the information handling system is enhanced by flowing a plurality of low density pills through the wellbore, wherein the low density pills are separated by a known distance interval; and the information handling system is further operable to use the known distance interval as the known dimension when constraining the model.

15. The surface tracking system of claim 11, wherein the gravity anomaly relates to a known change of density of the contents within the wellbore.

16. The surface tracking system of claim 15, wherein the drillstring has a known density and wherein the known dimension is a dimension of the drillstring, and wherein the information handling system is further operable to constrain the inversion algorithm using both the known dimension and the know density to determine the depth of the gravity anomaly.

17. The surface tracking system of claim 11, wherein the signal is enhanced by drilling the wellbore.

18. The surface tracking system of claim 17, wherein the signal is enhanced by drilling the wellbore at two different rates over two different lengths.

* * * * *